US007197872B2

(12) United States Patent
Satake et al.

(10) Patent No.: US 7,197,872 B2
(45) Date of Patent: Apr. 3, 2007

(54) HYDRAULIC CIRCUIT IN WORK VEHICLE

(75) Inventors: Hidetoshi Satake, Ishioka (JP); Hiroshi Tsukui, Abiko (JP); Kazuhiro Ichimura, Niihari-gun (JP); Hiroshi Onoue, Inashiki-gun (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 25 days.

(21) Appl. No.: 10/540,987

(22) PCT Filed: Dec. 27, 2002

(86) PCT No.: PCT/JP02/13831

§ 371 (c)(1),
(2), (4) Date: Jun. 27, 2005

(87) PCT Pub. No.: WO2004/061313

PCT Pub. Date: Jul. 22, 2004

(65) Prior Publication Data

US 2006/0163508 A1 Jul. 27, 2006

(51) Int. Cl.
*F15B 11/16* (2006.01)
*F15B 15/26* (2006.01)

(52) U.S. Cl. ..... 60/484; 91/445; 280/763.1

(58) Field of Classification Search ..... 91/455, 91/445; 60/484, 368; 280/763.1
See application file for complete search history.

(56) References Cited

U.S. PATENT DOCUMENTS 3,922,855 A * 12/1975 Bridwell et al. ..... 60/421
4,087,968 A * 5/1978 Bianchetta ..... 60/445
4,124,226 A * 11/1978 Phillips ..... 280/765.1
4,416,344 A * 11/1983 Nakada ..... 180/8.1
5,159,989 A * 11/1992 Claxton ..... 180/41

FOREIGN PATENT DOCUMENTS

EP 1 584 824 A1 10/2005
JP 53-43321 A 4/1978

(Continued)

OTHER PUBLICATIONS

International Search Report dated Apr. 15, 2003 (Two (2) pages).

(Continued)

*Primary Examiner*—Thomas E. Lazo
(74) *Attorney, Agent, or Firm*—Crowell & Moring LLP

(57) ABSTRACT

A hydraulic circuit includes a control valve that controls flow of pressure oil from a hydraulic source to work hydraulic cylinders, an operating device that issues a command for drive of the control valve, valve devices each comprising a check valve, each provided in correspondence to one of the plurality of work hydraulic cylinders to allow and prohibit outflow of pressure oil from a work hydraulic cylinder, a commanding device that outputs a command allowing or a command prohibiting extension/contraction for each of the work hydraulic cylinders and a control device that controls each of the valve devices to allow outflow of pressure oil from the work hydraulic cylinder by invalidating a check valve function in response to the command for allowing extension/contraction and to prohibit outflow of pressure oil from the work hydraulic cylinder with the check valve in response to the command for prohibiting extension/contraction.

5 Claims, 7 Drawing Sheets

FOREIGN PATENT DOCUMENTS

| | | | | |
|---|---|---|---|---|
| JP | 53-107795 | U | | 8/1978 |
| JP | 56160239 | A | * | 12/1981 |
| JP | 60-191584 | U | | 12/1985 |
| JP | 61-85559 | | | 6/1986 |
| JP | 63-4772 | U | | 1/1988 |
| JP | 64-24163 | U | | 2/1989 |
| JP | 6424163 | U | * | 2/1989 |
| JP | 1-103466 | U | | 7/1989 |
| JP | 01309859 | A | * | 12/1989 |
| JP | 2-33162 | U | | 3/1990 |
| JP | 2-74446 | A | | 3/1990 |
| JP | 2-89051 | | | 7/1990 |
| JP | 03008932 | A | * | 1/1991 |
| JP | 5-52302 | U | | 7/1993 |
| JP | 6-8460 | U | | 2/1994 |
| JP | 8-270608 | A | | 10/1996 |
| JP | 63-255161 | | | 10/1998 |
| JP | 11092085 | A | * | 4/1999 |
| JP | 2002081409 | A | * | 3/2002 |
| WO | WO 2004/061312 | A1 | | 7/2004 |

OTHER PUBLICATIONS

International Search Report dated Apr. 30, 2003 (Two (2) pages).

* cited by examiner

HYDRAULIC CIRCUIT IN WORK VEHICLE

TECHNICAL FIELD

The present invention relates to a hydraulic circuit in a work vehicle, which drives an outrigger cylinder, a blade cylinder or the like disposed at an undercarriage of a rotatable work vehicle such as a wheel hydraulic excavator.

BACKGROUND ART

Hydraulic circuits used for outrigger cylinder drive in the related art include, for instance, the hydraulic circuit disclosed in Japanese Laid Open Utility Model Publication No. S63-4772.

In conjunction with the hydraulic circuit disclosed in this publication, the bottom chambers or the rod chambers of outrigger cylinders disposed to the front, the rear, the left side and the right side of the vehicle are individually made to communicate via hydraulic pilot switching valves. In response to a switching operation at the switching valve, pressure oil is allowed to flow to a desired hydraulic cylinder while cutting off the flow of pressure oil to the other hydraulic cylinders. This system makes it possible to operate the outriggers on the front side, the rear side, the left side and the right side independently of one another.

However, if high pressure oil is applied to hydraulic cylinders in the circuit disclosed in the publication described above, in which the oil flow is cut off with the switching valve, the oil may leak from the switching valve and in such a case, it may not be possible to hold the vehicle body in a jacked up state. While a leakless switching valve may be utilized to avoid this problem, the use of the leakless switching valve is bound to be costly.

DISCLOSURE OF THE INVENTION

An object of the present invention is to provide a drive circuit for a work hydraulic cylinder, achieving a structure capable of maintaining an extension/contraction state of the hydraulic cylinder at low cost.

A hydraulic circuit in a work vehicle according to the present invention includes an undercarriage, a revolving superstructure rotatably mounted atop the undercarriage, a hydraulic source disposed at the revolving superstructure, at least a plurality of work hydraulic cylinders disposed at the undercarriage, that are to be driven by pressure oil from the hydraulic source, a control valve that controls flow of pressure oil from the hydraulic source to the work hydraulic cylinders, an operating means for issuing a command for drive of the control valve, valve devices each comprising a check valve, each provided in correspondence to one of the plurality of work hydraulic cylinders to allow and prohibit outflow of pressure oil from a work hydraulic cylinder, a commanding means for outputting one of a command for allowing extension/contraction and a command for prohibiting extension/contraction for each of the work hydraulic cylinders, and a control means for controlling each of the valve devices so as to allow outflow of pressure oil from the work hydraulic cylinder by invalidating a check valve function thereof in response to the command for allowing extension/contraction output from the commanding means and so as to prohibit outflow of pressure oil from the work hydraulic cylinder with the check valve in response to the command for prohibiting extension/contraction output by the commanding means.

In this manner, leakage of pressure oil from the hydraulic cylinder can be prevented and an extension/contraction state of the hydraulic cylinder can be maintained at low cost.

The hydraulic circuit may be formed so that oil flows between the undercarriage and the revolving superstructure via a pair of pipelines and that the pair of pipelines are branched in the undercarriage to connect with each of the work hydraulic cylinders.

The valve devices may be constituted as pilot-operated check valves controlled by a pilot pressure. In this case, it is preferable that a pilot hydraulic circuit is formed so as to guide the pilot pressure from the revolving superstructure to the undercarriage via a single pilot pipeline and so as to branch the pilot pipeline in the undercarriage to connect with each of the valve devices.

The valve devices may also be constituted as solenoid controlled directional control valves, each comprising a check valve.

Outflow of pressure oil from the work hydraulic cylinders may be allowed if the command for allowing extension/contraction is output from the commanding means and the operation of the operating means is detected with the detection means.

BEST MODE FOR CARRYING OUT THE INVENTION

First Embodiment

The following is an explanation of the first embodiment achieved by adopting a hydraulic circuit according to the present invention in a wheel hydraulic excavator, given in reference to FIGS. 1 to 5.

Figure 1:
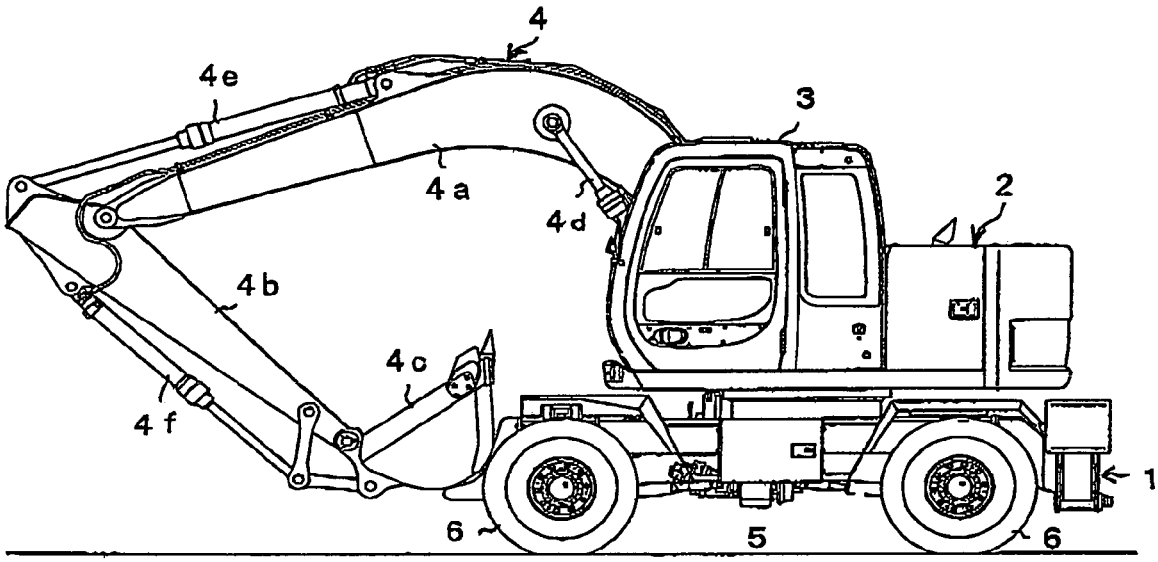
FIG. 1 is an external view of a wheel hydraulic excavator in which the present invention is adopted.

As shown in FIG. 1, the wheel hydraulic excavator includes an undercarriage 1 and a revolving superstructure or revolving upperstructure 2 rotatably mounted atop the undercarriage 1. An operator cab 3 and a work front attachment 4 constituted with a boom 4*a*, an arm 4*b* and a bucket 4*c* are disposed at the revolving superstructure 2. The boom 4*a* is hoisted as a boom cylinder 4*d* is driven, the arm 4*b* is hoisted as an arm cylinder 4*e* is driven and the bucket 4*c* is engaged in a lift operation or a dump operation as a bucket cylinder 4*f* is driven. A traveling motor 5, which is hydraulically driven, is disposed at the undercarriage 1, and the rotation of the traveling motor 5 is transmitted to wheels 6 (tires) via a drive shaft and axles.

Figure 2:
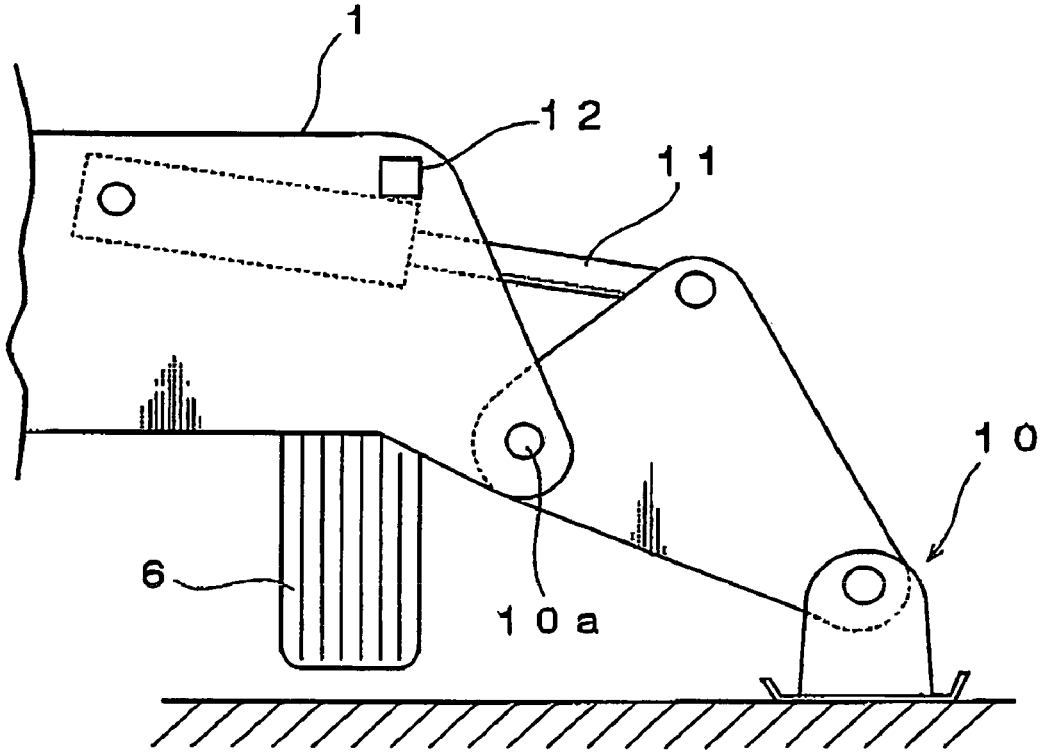
FIG. 2 is an enlargement of an essential portion of FIG. 1.

As shown in FIG. 2, an outrigger 10 is disposed near each of the tires 6 disposed at the front and the rear of the undercarriage 1 on the left and right sides. An outrigger cylinder 11 is attached to the outrigger 10 and as the cylinder 11 extends and contracts, the outrigger 10 rotates with a hinge pin 10*a* acting as its fulcrum. As the cylinder 11 extends, the outrigger 10 is lowered to the ground to lift the vehicle off the ground (jack up), and as the cylinder 11 contracts and retracts, the outrigger 10 is stored into the undercarriage 1, thereby lowering the vehicle onto the ground (jack down).

Figure 3:
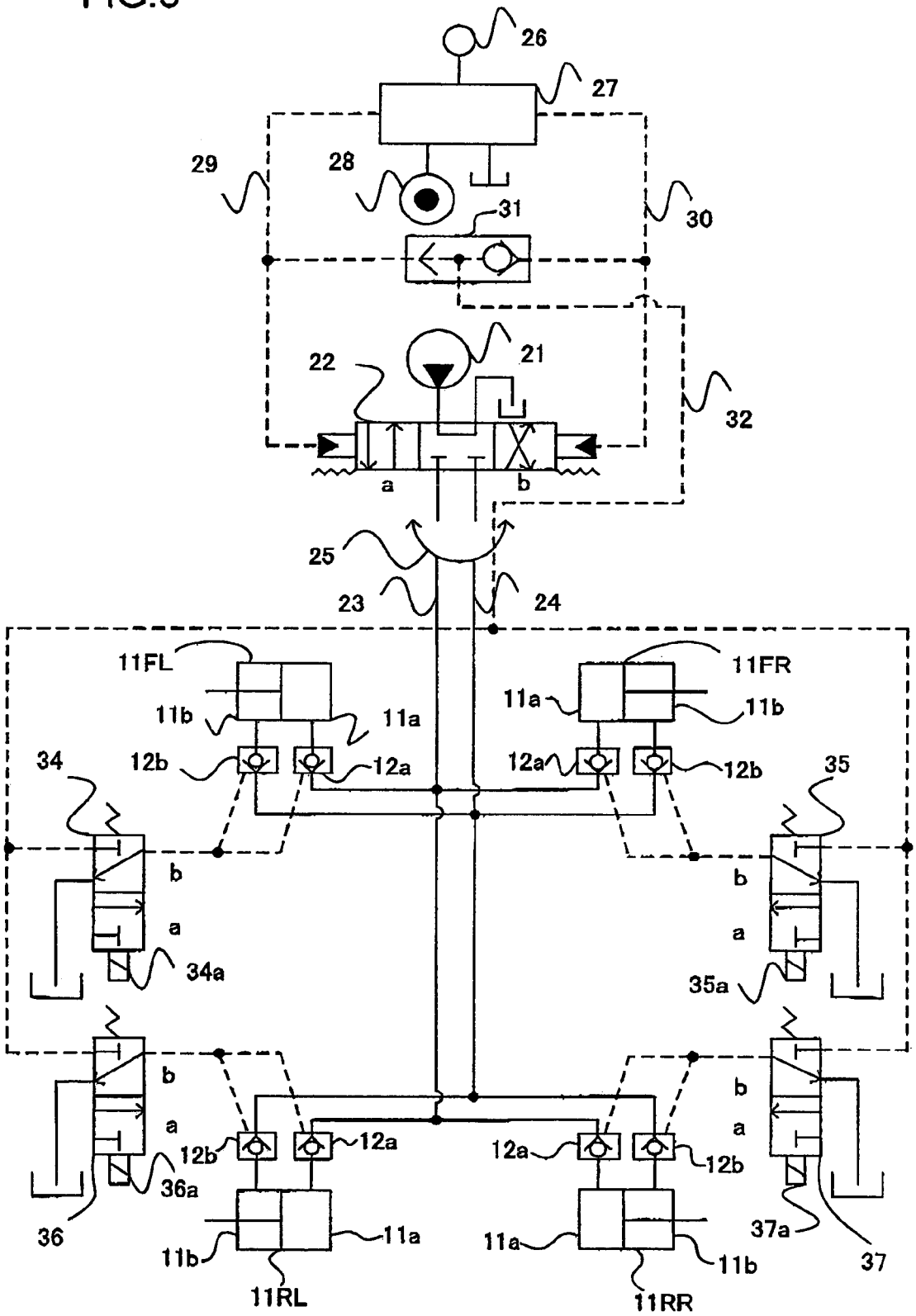
FIG. 3 is a hydraulic circuit diagram pertaining to a first embodiment of the present invention.

FIG. 3 is a hydraulic circuit diagram pertaining to the first embodiment of the present invention showing a drive circuit for the outrigger cylinders 11 as its main feature. It is to be noted that reference numerals 11FL, 11FR, 11RL and 11RR respectively indicate the outrigger cylinders 11 at the front left, the front right, the rear left and the rear right of the vehicle.

In the circuit shown in FIG. 3, the pressure oil from a hydraulic pump 21 disposed at the revolving superstructure 2 travels through a center joint 25 via a directional control valve 22 and a pipeline 23 or 24 and is guided to the undercarriage. The oil returning from the undercarriage 1 travels through the center joint 25 via the pipeline 24 or 23 and is guided to a reservoir.

The directional control valve 22 is switched in response to an operation of an operation lever 26. Namely, as the operation lever 26 is operated, a pressure reducing valve 27 is driven in correspondence to the extent to which the operation lever is operated and a pilot pressure from a hydraulic source 28 is applied to a pilot port at the directional control valve 22 via a pilot pipeline 29 or 30, thereby switching the directional control valve 22. A shuttle valve 31 is disposed between the pilot pipelines 29 and 30, and the pilot pressure generated at the revolving superstructure 2 is guided to the undercarriage 1 after passing through the center joint 25 via the shuttle valve 31 and a pilot pipeline 32.

Pilot-operated check valves 12*a* and 12*b* are respectively disposed on the intake side of a bottom chamber 11*a* and a rod chamber 11*b* of each of the outrigger cylinders 11FL, 11FR, 11RL and 11RR. The bottom chambers 11*a* communicate with one another via the pilot-operated check valves 12*a* and they also connect with the pipeline 23. The rod chambers 11*b* communicate with one another via the pilot-operated check valves 12*b* and they also connect with the pipeline 24.

The pilot-operated check valves 12*a* and 12*b* are controlled by a pilot pressure supplied from the outside. Pilot ports of the pilot-operated check valves 12*a* and 12*b* are connected to the pilot pipeline 32 via solenoid controlled directional control valves 34 to 37 provided in correspondence to the outrigger cylinders 11FL, 11FR, 11RL and 11RR respectively. Solenoids 34*a* to 37*a* of the solenoid controlled directional control valves 34 to 37 are excited or demagnetized in response to electrical signals output via, for instance, slip-rings from the revolving superstructure 2.

As the solenoids 34*a* to 37*a* become excited, the respective solenoid controlled directional control valves 34 to 37 are each switched to a position "a", and, as a result, the pilot pressure from the pilot pipeline 32 is applied to the pilot-operated check valves 12*a* and 12*b*. This invalidates the function of the pilot-operated check valves 12*a* and 12*b* as check valves and the pilot-operated check valves 12*a* and 12*b* are allowed to function simply as open valves, thereby allowing the pressure oil to flow out from the bottom chambers 11*a* and the rod chambers 11*b*.

As the solenoids 34*a* to 37*a* become demagnetized, the respective solenoid controlled directional control valves 34 to 37 are each switched to a position "b", thereby stopping the supply of the pilot pressure to the pilot-operated check valves 12*a* and 12*b*. As a result, the pilot-operated check valves 12*a* and 12*b* function as check valves and the flow of pressure oil out of the bottom chambers 11*a* and the rod chambers 11*b* becomes prohibited. Since the pilot-operated check valves 12*a* and 12*b* all adopt a structure having a poppet valve which becomes pressed against the surface of the main unit seat by the pressure generated in a reverse flow instead of a structure having a spool that moves within a valve unit as in a switching valve, hardly any leak occurs and the cost of such pilot-operated check valves can be kept low.

Figure 4:
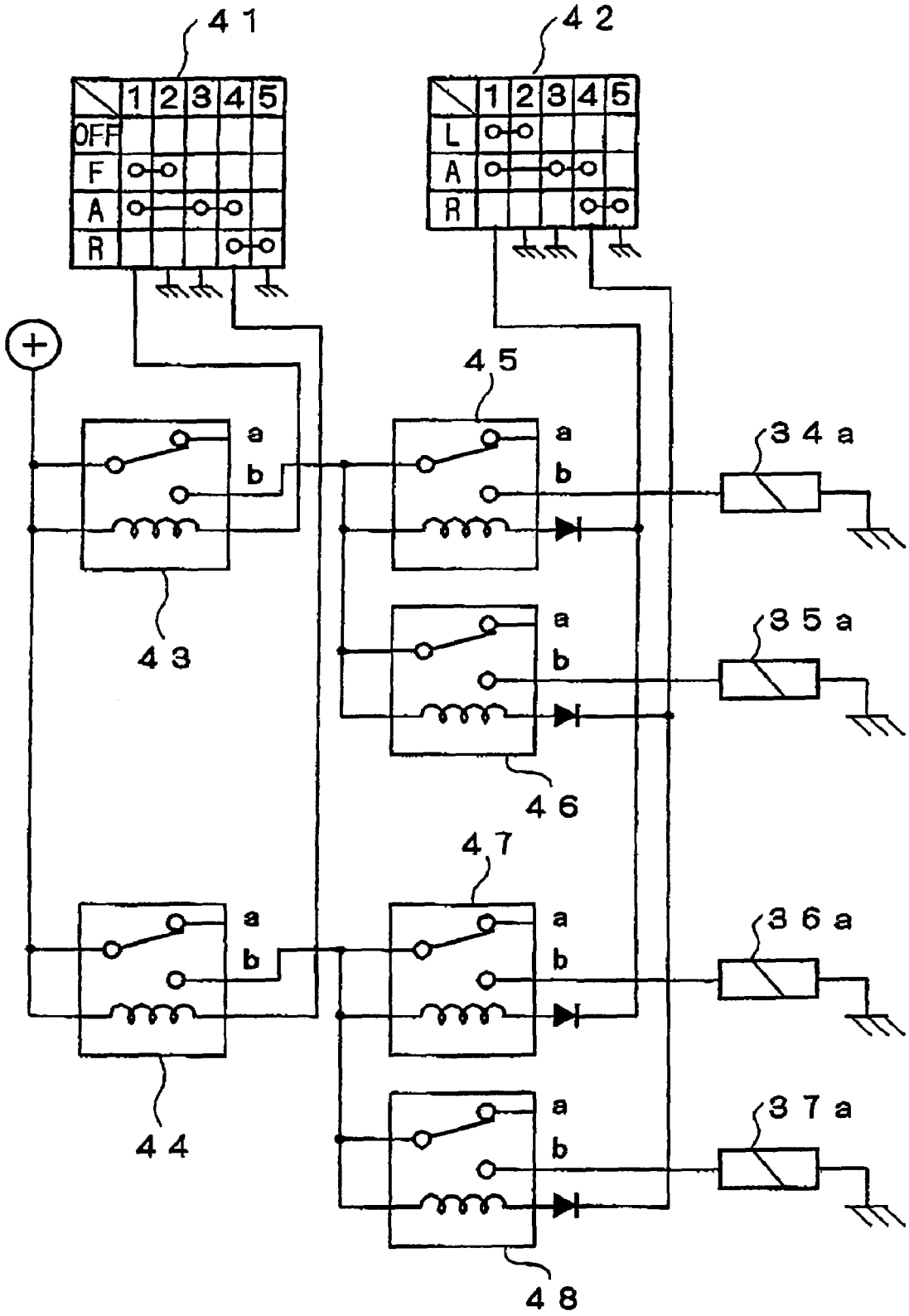
FIG. 4 shows a relay circuit that controls solenoid controlled directional control valves in FIG. 3.

FIG. 4 shows a relay circuit that controls the power supply to the solenoids 34*a* to 37*a*. This relay circuit is switched in response to operations of, for instance, a dial-type front/rear selector switch 41 and a dial-type left/right selector switch 42 shown in FIG. 5. The switches 41 and 42 are installed in the operator's cab 3.

Figure 5:
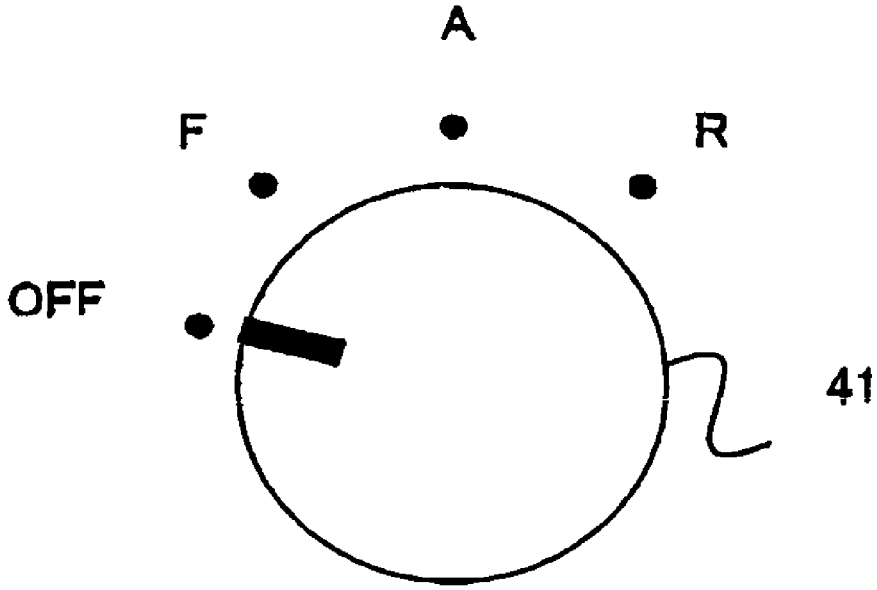
FIG. 5 shows an operating member that outputs control commands for the solenoid controlled directional control valves.
Figure 5:
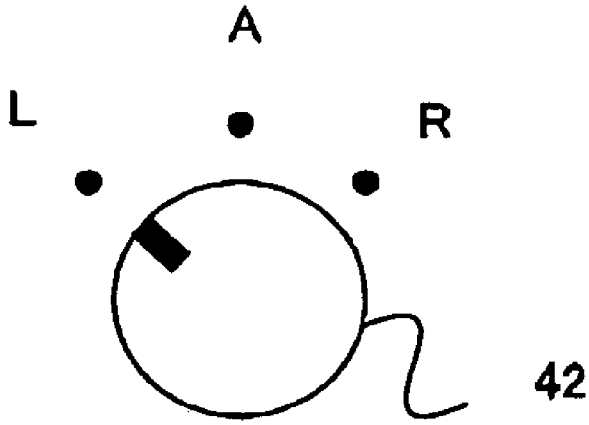

As shown in FIG. 5, the front/rear selector switch 41 can be operated to an OFF position, an F position, an A position or an R position to selectively operate the outrigger cylinders 11FL and 11FR on the front side and the outrigger cylinders 11RL and 11RR on the rear side. Namely, the switch 41 is operated to the F position to drive the front-side cylinders 11FL and 11FR, is operated to the R position to drive the rear-side cylinders 11RL and 11RR, is operated to the A position to drive the cylinders 11FL, 11FR, 11RL and 11RR on both the front side and the rear side and is operated to the OFF position if none of the cylinders 11FL, 11FR, 11RL and 11RR is to be driven.

The left/right selector switch 42, which can be operated to an L position, an A position or an R position, is used to selectively operate the outrigger cylinders 11FL and 11RL and the outrigger cylinders 11FR and 11RR on the left side and the right side. Namely, the switch 42 is operated to the L position to drive the left-side cylinders 11FL and 11RL, is operated to the R position to drive the right-side cylinders 11FR and 11RR and is operated to the A position to drive the cylinders 11FL, 11FR, 11RL and 11RR on both the left side and the right side.

Through the switch operations described above, an allow extension/contraction command or a prohibit extension/contraction command is output to each of the outrigger cylinders 11FL, 11FR, 11RL and 11RR.

The relay circuit in FIG. 4 is now explained. If the front/rear selector switch 41 in FIG. 4 is operated to the OFF position, no power is supplied to coils at relays 43 and 44 and, as a result, the relays 43 and 44 are each switched to a contact point "a". Consequently, the solenoids 34*a* to 37*a* are all demagnetized. As the front/rear selector switch 41 is operated to the F position, terminals 1 and 2 at the switch 41 come into communication with each other as shown in the figure and power is thus supplied to the coil at the relay 43 thereby switching the relay 43 to a contact point "b". As the front/rear selector switch 41 is operated to the R position, switch terminals 4 and 5 come into communication with each other and thus, power is supplied to the coil at the relay 44 to switch the relay 44 to a contact point "b". As the selector switch 41 is operated to the A position, the switch terminals 1, 3 and 4 come into communication with one another, and power is thus supplied to the coils at the relays 43 and 44, thereby switching both the relays 43 and 44 to their contact points "b".

If the left/right selector switch 42 is operated to the L position after the relay 43 is switched to the contact point "b", terminals 1 and 2 at the switch 42 come into communication with each other, as shown in the figure, power is supplied to a coil at a relay 45, thereby switching the relay 45 to a contact point "b". As a result, the solenoid 34*a* becomes excited. If the left/right selector switch 42 is operated to the R position, switch terminals 4 and 5 come into communication with each other and power is thus supplied to a coil at a relay 46, thereby switching the relay 46 to a contact point "b". Consequently, the solenoid 35*a* becomes excited. If the left/right selector switch 42 is operated to the A position, the switch terminals 1, 3 and 4 come into communication with one another and power is thus supplied to the coils at the relays 45 and 46, thereby switching both the relays 45 and 46 to their contact points "b". As a result, the solenoids 36*a* and 37*a* are both excited.

If the left/right selector switch 42 is operated to the L position after the relay 44 is switched to the contact point "b", the switch terminals 1 and 2 come into communication with each other and power is supplied to a coil at a relay 47, thereby switching the relay 47 to a contact point "b". As a result the solenoid 36*a* becomes excited. If the left/right selector switch 42 is operated to the R position, the switch terminals 4 and 5 come into communication with each other and power is supplied to a coil at a relay 48, thereby switching the relay 48 to a contact point "b". Consequently, the solenoid 37*a* becomes excited. If the left/right selector switch 42 is operated to the A position, the switch terminals 1, 3 and 4 come into communication with one another and power is thus supplied to the coils at the relays 47 and 48, thereby switching both the relays 47 and 48 to their contact points "b". As a result, the solenoid 36*a* and 37*a* become excited.

The operation that characterizes the hydraulic circuit achieved in the first embodiment is now explained.

When the vehicle body is not to be jacked up or down (here after referred to as jack up/down) the front/rear selector switch 41 is operated to the OFF position. In response to this switch operation, a command for prohibiting extension or contraction of all the outrigger cylinders 11 is output, and the solenoids 34*a* to 37*a* are all demagnetized as described earlier, thereby switching the individual solenoid controlled directional control valves 34 to 37 to the position "b". As a result, the communication of the pilot-operated check valves 12*a* and 12*b* with the pilot pipeline 32 becomes cut off, and the pilot-operated check valves 12*a* and 12*b*, with no pilot pressure supplied thereto, function as check valves. In this state, even if the directional control valve 22 is switched and pressure oil is guided from the hydraulic pump 21 to the outrigger cylinders 11, the pressure oil is not allowed to flow out of the bottom chambers 11*a* and the rod chambers 11*b*. Thus, the cylinders 11 cannot be extended or contracted and the jack up/down of the vehicle body is prohibited.

In order to jack up/down the front of the vehicle body on the left side and the right side, for instance, the front/rear selector switch 41 is operated to the F position and the left/right selector switch 42 is operated to the A position. In response to these switch operations, a command for allowing extension and contraction of the outrigger cylinders 11FL and 11FR and a command for prohibiting extension or contraction of the outrigger cylinders 11RL and 11RR are output. As a result, the solenoids 34*a* and 35*a* become excited, thereby switching the solenoid controlled directional control valves 34 and 35 to the position "a".

As the operation lever 26 currently at the neutral position is operated in this state, the pilot pressure from the hydraulic source 28 is applied to the pilot-operated check valves 12*a* and 12*b* of the outrigger cylinders 11FL and 11FR via the pipeline 32, thereby enabling the pilot-operated check valves 12*a* and 12*b* to function as open valves. In addition, the pilot pressure from the hydraulic source 28 is also applied to the directional control valve 22 to switch the directional control valve 22 to the position "a" or the position "b". In response, the pressure oil from the hydraulic pump 21 is guided to the bottom chambers 11*a* or the rod chambers 11*b* of the outrigger cylinders 11FL and 11FR and the pressure oil is discharged from the rod chambers 11*b* or the bottom chambers 11*a*. The front side outrigger cylinders 11FL and 11FR can thus be engaged in operation simultaneously to jack up/down the front side of the vehicle body.

In order to jack up/down only either the left side or the right side (e.g., the left side) of the vehicle body at the front, the front/rear selector switch 41 is operated to the F position and also, the left/right selector switch 42 is operated to the L position. In response to these switch operations, a command for allowing extension and contraction of the outrigger cylinder 11FL and a command for prohibiting extension or contraction of the outrigger cylinders 11FR, 11RL and 11RR are output. As a result, the solenoid 34*a* becomes excited and the solenoid controlled directional control valve 34 alone is switched to the position "a". As the operation lever 26 currently at the neutral position is operated in this state, the pilot pressure is applied to the pilot-operated check valves 12*a* and 12*b* of the outrigger cylinder 11FL and thus the front-side cylinder 11FL alone is engaged in operation independently of the others with the pressure oil supplied from the hydraulic pump 21.

In order to jack up/down the rear of the vehicle body on the left side and the right side, the front/rear selector switch 41 is operated to the R position and the left/right selector switch 42 is operated to the A position. In response, the solenoids 36*a* and 37*a* become excited, thereby switching the solenoid controlled directional control valves 36 and 37 to the position "a". As the operation lever 26 currently at the neutral position is operated in this state, the pilot pressure is applied to the pilot-operated check valves 12*a* and 12*b* of the outrigger cylinders 11RL and 11RR to engage the rear side outrigger cylinders 11RL and 11RR in operation at the same time, and thus, the rear side of the vehicle body is jacked up/down.

In order to jack up/down only either the left side or the right side (e.g., the left side) of the vehicle body at the rear, the front/rear selector switch 41 is operated to the R position and also, the left/right selector switch 42 is operated to the L position. In response, the solenoid 36*a* becomes excited and the solenoid controlled directional control valve 36 alone is switched to the position "a". As the operation lever 26 currently at the neutral position is operated in this state, the pilot pressure is applied to the pilot-operated check valves 12*a* and 12*b* of the outrigger cylinder 11RL and thus, the rear-side cylinder 11RL alone is engaged in operation independently of the others with the pressure oil supplied from the hydraulic pump 21.

In order to jack up/down the left side or the right side of the vehicle body both at the front and at the rear, the front/rear selector switch 41 is operated to the A position and the left/right selector switch 42 is operated to the L position or the R position. In response, the solenoids 34*a* and 36*a* or the solenoids 35*a* and 37*a* become excited, thereby switching the solenoid controlled directional control valves 34 and 36 or 35 and 37 to the position "a". As the operation lever 26 currently at the neutral position is operated in this state, the pilot pressure is applied to the pilot-operated check valves 12*a* and 12*b* of the outrigger cylinders 11FL and 11RL or the outrigger cylinders 11FR and 11RR to jack up/down the left side or the right side of the vehicle body.

In order to jack up/down the entire vehicle body, the front/rear selector switch 41 is operated to the A position and the left/right selector switch 42 is operated to the A position.

In response, all the solenoids 34*a* to 37*a* become excited, thereby switching the solenoid controlled directional control valves 34 to 37 to the position "a". As the operation lever 26 is operated in this state, the pilot pressure is applied to the pilot-operated check valves 12*a* and 12*b* of the outrigger cylinders 11FL, 11FR, 11RL and 11RR to jack up/down the entire vehicle body.

The following advantages can be achieved in the first embodiment.

(1) The pilot-operated check valves 12*a* and 12*b* are disposed on the intake side of the bottom chamber 11*a* and the rod chamber 11*b* of each of the outrigger cylinders 11FL, 11FR, 11RL and 11RR, and the solenoid controlled directional control valves 34 to 37 are switched in response to switch operations to apply the pilot pressure to the corresponding pilot-operated check valves 12*a* and 12*b*. Thus, the individual outrigger cylinders 11FL, 11FR, 11RL and 11RR are allowed to be engaged in operation independently of one another and the vehicle body can be jacked up/down in any desired manner. In addition, a structure in which leakage of pressure oil from the outrigger cylinders 11 can be prevented and a specific jacked-up state can be maintained is achieved at low cost.

(2) The pressure oil from the hydraulic pump 21 is guided to the undercarriage 1 via a pair of pipelines 23 and 24 which are branched on the side where the undercarriage 1 is located to individually connect with the outrigger cylinders 11FL, 11FR, 11RL and 11RR. This makes it possible to reduce the number of high-pressure pipings passing through the center joint 25, which, in turn, makes it possible to miniaturize the center joint 25.

(3) The flows of pressure oil to the outrigger cylinders 11FL, 11FR, 11RL and 11RR can be individually controlled with the single operation lever 26 and the directional control valve 22 alone and thus, the number of required parts can be reduced.

(4) The pilot pressure from the hydraulic source 28 is guided to the undercarriage 1 via the single pilot pipeline 32, and the pipeline 32 is branched on the side where the undercarriage 1 is located to individually connect with the pilot-operated check valves 12*a* and 12*b*. Thus, the number of pilot pipings passing through the center joint 25 can be reduced and the center joint 25 can be miniaturized.

(5) The pilot pressure is supplied to the directional control valve 22 and the pilot-operated check valves 12*a* and 12*b* by operating the operation lever 26 and thus, the pilot-operated check valves 12*a* and 12*b* are engaged in operation by interlocking with the operation of the operation lever 26. As a result, any undesirable movement of the outrigger cylinders 11 immediately after the solenoid controlled directional control valves 34 to 37 are switched in response to switch operations is prohibited to improve the reliability of the outriggers 10.

Second Embodiment

Figure 6:
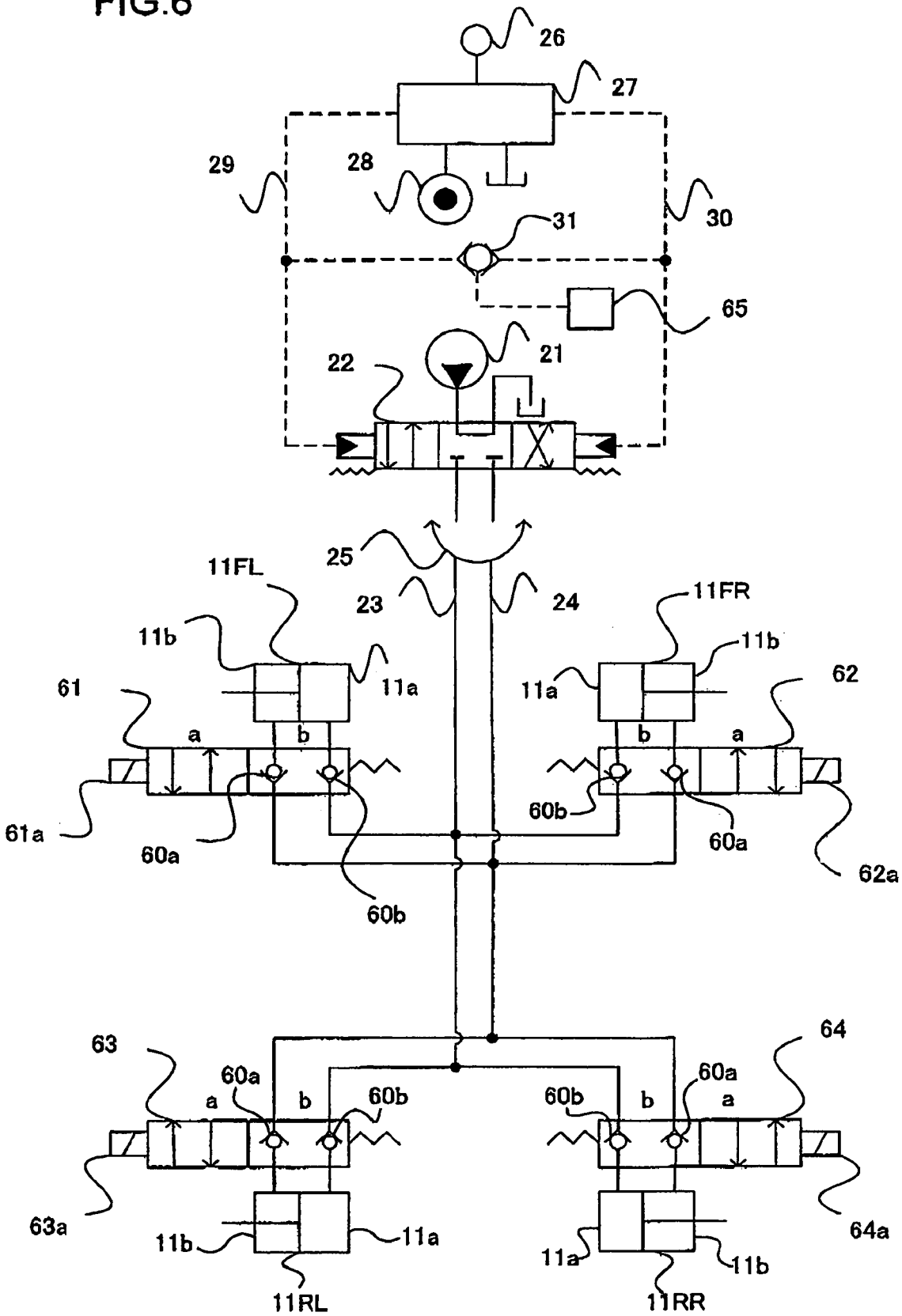
FIG. 6 is a hydraulic circuit diagram pertaining to a second embodiment of the present invention.
Figure 7:
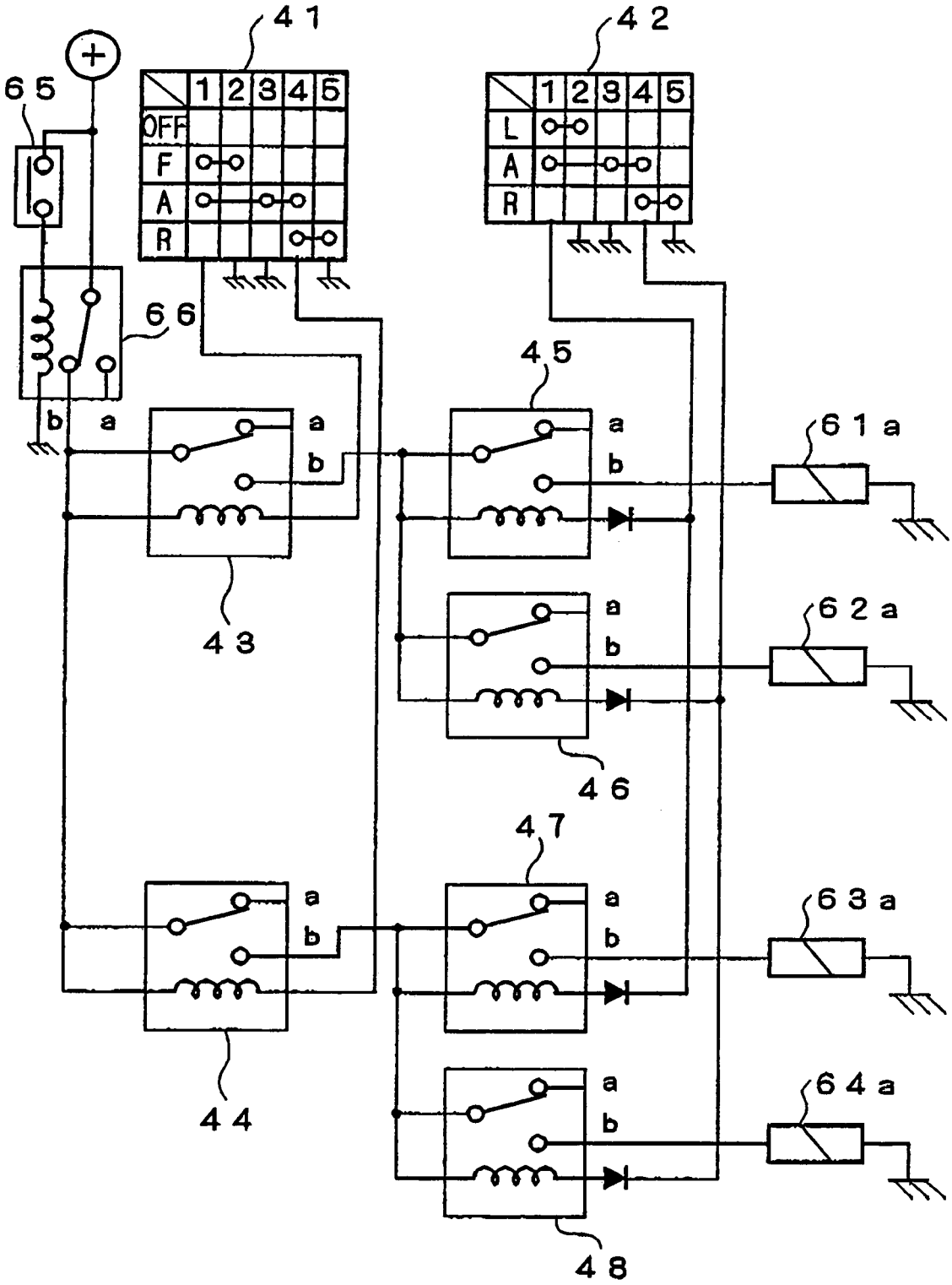
FIG. 7 shows a relay circuit that controls the solenoid controlled directional control valves in FIG. 6.

The second embodiment of the present invention is explained in reference to FIGS. 6 and 7.

While the pilot-operated check valves 12*a* and 12*b* are disposed on the intake side of the oil chambers 11*a* and 11*b* of the outrigger cylinders 11 and their function as check valves is invalidated by the pilot pressure from the revolving superstructure 2 in the first embodiment, the function as check valves is invalidated by an electrical signal originating from the revolving superstructure 2 in the second embodiment.

FIG. 6 is a hydraulic circuit diagram pertaining to the second embodiment of the present invention, showing a drive circuit for the outrigger cylinders 11 as its main feature. It is to be noted that the same reference numerals are assigned to components identical to those in FIG. 3 and the following explanation focuses on differentiating features.

Solenoid controlled directional control valves 61 to 64, instead of the pilot-operated check valves 12*a* and 12*b*, are disposed on the intake side of the bottom chambers 11*a* and the rod chambers 11*b* of the individual outrigger cylinders 11FL, 11FR, 11RL and 11RR respectively. Accordingly, no pilot pipeline passes through the center joint 25 unlike in the first embodiment, and the number of pipelines passing through the center joint 25 is smaller than that in the first embodiment for this reason. A pressure switch 65 is connected to the shuttle valve 31. The pressure switch 65 is turned on by pilot pressure generated in response to an operation of the operation lever 26, and the operation of the operation lever 26 is thus detected.

The solenoid controlled directional control valves 61 to 64 each include built-in check valves 60*a* and 60*b*. As solenoids 61*a* to 64*a* of the solenoid controlled directional control valves 61 to 64 in FIG. 6 become excited, the solenoid controlled directional control valves 61 to 64 are each switched to the position "a". Under such circumstances, the solenoid controlled directional control valves function simply as open valves, allowing pressure oil to flow out from the bottom chambers 11*a* and the rod chambers 11*b*. As the solenoids 61*a* to 64*a* become demagnetized, the solenoid controlled directional control valves 61 to 64 are each switched to the position "b". In response, the outflow of the pressure oil from the bottom chambers 11*a* and the rod chamber 11*b* becomes prohibited by the check valves 60*a* and 60*b*.

FIG. 7 shows a relay circuit that controls the power supply to the solenoids 61*a* to 64*a*. It is to be noted that the same reference numerals are assigned to components identical to those in FIG. 4 and the following explanation focuses on differentiating features. As the pressure switch 65 in FIG. 7 is turned on, power is supplied to a coil of a relay 66, thereby switching the relay 66 to a contact point "b". Thus, relays 43 to 48 are switched in response to operations of the switches 41 and 42 to excite or demagnetize the solenoids 61*a* to 64*a* as in the first embodiment.

The operation characterizing the second embodiment is now explained.

When the operation lever 26 is set to the neutral position, the pressure switch 65 is turned off and the relay 66 is switched to a contact point "a". In this state, the solenoids 61*a* to 64*a* remain demagnetized at all times regardless of the positions of the switches 41 and 42. The solenoid controlled directional control valves 61 to 64 are thus all switched to the position "b", the outrigger cylinders 11 are not extended or contracted and the jack up/down operation of the vehicle body is prohibited.

As the operation lever 26 currently at the neutral position is operated, the pressure switch 65 is turned on and the relay 66 is switched to the contact point "b". In this state, the solenoids 61*a* to 64*a* become excited in response to operations of the switches 41 and 42 and the corresponding solenoid controlled directional control valves 61 to 64 are switched to the position "a", as in the first embodiment. As a result, the outrigger cylinders 11 are extended or contracted in response to an operation of the operation lever 26 to jack up/down the vehicle body.

As described above, the solenoid controlled directional control valves 61 to 64 each having the check valves 60*a* and 60*b* are disposed on the intake side of the oil chambers 11*a* and 11*b* of the individual outrigger cylinders 11FL, 11FR, 11RL and 11RR and the solenoid controlled directional control valves 61 to 64 are switched in response to switch operations in the second embodiment. Thus, the drive of each of the outrigger cylinders 11FL, 11FR, 11RL and 11RR can be enabled or prohibited independently and, at the same time, leakage of pressure oil from the cylinders 11 can be prevented in an inexpensive structure. Since no pilot pipeline needs to pass through the center joint 25, the center joint 25 can be further miniaturized. An operation at the operation lever 26 is detected with the pressure switch 65, and if the drive of an outrigger cylinder 11 is selected through a switch operation while the pressure switch 65 is in an on state, the corresponding solenoid among the solenoids 61*a* to 64*a* is excited, thereby preventing any undesirable movement of the outrigger cylinders 11 when the operation lever 26 is not operated.

It is to be noted that while the pilot pressure generated in response to an operation of the operation lever 26 is guided to the pilot pipeline 32 via the shuttle valve 31 in the first embodiment, the operation of the operation lever 26 may be detected with a pressure sensor 65 instead, as in the second embodiment, and the pilot pressure may be guided to the pilot pipeline 65 when the pressure switch 65 is in an on state.

While the check valve function is invalidated by interlocking with an operation of the operation lever 26 in the embodiments described above, the check valve function does not need to be invalidated by interlocking with the operations of the operation lever 26 and instead, the check valve function may be invalidated simply in response to operations of the switches 41 and 42.

While an explanation is given above in reference to the embodiments on a hydraulic circuit that includes the outrigger cylinders 11FL, 11FR, 11RL and 11RR disposed on the left side and the right side of the vehicle body at the front and the rear, the present invention may be adopted equally effectively in a hydraulic circuit having outrigger cylinders only either on the front side or the rear side of the vehicle body, e.g., outrigger cylinders 11RL and 11RR (rear side only) The present invention may also be adopted with equal effectiveness in conjunction with work hydraulic cylinders (e.g., blade cylinders), as well as in conjunction with the outrigger cylinders 11 disposed at the undercarriage 1.

A command for the drive of the directional control valve 22 may be issued through an operating member (e.g., a switch) other than the operation lever 26. While the allow extension/contraction command and the prohibit extension/contraction command are output through the dial-type switches 41 and 42, ON/OFF switches (e.g., toggle switches) may instead be provided in a quantity corresponding to the number of outrigger cylinders 11FL, 11FR, 11RL and 11RR and the allow extension/contraction command and the prohibit extension/contraction command may be output through operations of these switches.

While the power supply to the solenoids 34*a* to 37*a* or 61*a* to 64*a* is controlled with a relay circuit, signals originating from the operation lever 26 and the switches 41 and 42 may be taken into a computer to enable computer control. In other words, the control means may adopt a structure other than those explained in reference to the embodiments.

INDUSTRIAL APPLICABILITY

While an explanation is given above on an example in which the present invention is adopted in a wheel hydraulic excavator, the present invention may be adopted in other types of work vehicles including construction machines such as wheel loaders and truck cranes, as well. It may also be adopted in conjunction with jack-up cylinders for large cranes.

The invention claimed is:

1. A hydraulic circuit in a work vehicle, comprising:

an undercarriage;

a revolving superstructure rotatably mounted atop the undercarriage;

a hydraulic source disposed at the revolving superstructure;

at least a plurality of work hydraulic cylinders disposed at the undercarriage, that are to be driven by pressure oil from the hydraulic source;

a control valve that controls flow of pressure oil from the hydraulic source to the work hydraulic cylinders;

an operating device that issues a command for drive of the control valve;

valve devices each comprising a check valve, each provided in correspondence to one of the plurality of work hydraulic cylinders to allow and prohibit outflow of pressure oil from a work hydraulic cylinder;

a commanding device that outputs one of a command for allowing extension/contraction and a command for prohibiting extension/contraction for each of the work hydraulic cylinders;

a control device that controls each of the valve devices so as to allow outflow of pressure oil from the work hydraulic cylinder by invalidating a check valve function thereof in response to the command for allowing extension/contraction output from the commanding device and an operation of the operating device, and so as to prohibit outflow of pressure oil from the work hydraulic cylinder with the check valve in response to the command for prohibiting extension/contraction output by the commanding device, wherein the control device also prohibits outflow of pressure oil from the work hydraulic cylinder with the check valve while the operating device is not operated.

2. A hydraulic circuit in a work vehicle according to claim 1, wherein:

the hydraulic circuit is formed so that oil flows between the undercarriage and the revolving superstructure via a pair of pipelines through which drive pressure is supplied to the work hydraulic cylinders and the drive pressure is then returned and that the pair of pipelines are branched in the undercarriage to connect with each of the work hydraulic cylinders.

3. A hydraulic circuit in a work vehicle according to claim 1, wherein:

the valve devices are constituted as pilot-operated check valves controlled by a pilot pressure.

4. A hydraulic circuit in a work vehicle according to claim 3, wherein:

a pilot hydraulic circuit is formed so as to guide the pilot pressure generated at the revolving superstructure in response to an operation at the operating device to the undercarriage via a single pilot pipeline and so as to branch the pilot pipeline in the undercarriage to connect with each of the valve devices.

5. A hydraulic circuit in a work vehicle according to claim 1, wherein the valve devices are constituted as switching valves, each comprising a check valve, which is controlled by an electrical signal.

* * * * *